US008946600B1

(12) United States Patent
Dupuis

(10) Patent No.: US 8,946,600 B1
(45) Date of Patent: Feb. 3, 2015

(54) ROOF DE-ICING SYSTEM

(76) Inventor: Ricky R. Dupuis, Fitchburg, MA (US)

( * ) Notice: Subject to any disclaimer, the term of this patent is extended or adjusted under 35 U.S.C. 154(b) by 568 days.

(21) Appl. No.: 13/096,778

(22) Filed: Apr. 28, 2011

(51) Int. Cl.
*H05B 1/00* (2006.01)
*H05B 3/00* (2006.01)
*H05B 11/00* (2006.01)

(52) U.S. Cl.
USPC ..... 219/213

(58) Field of Classification Search
USPC ..... 219/201, 213
See application file for complete search history.

(56) References Cited

U.S. PATENT DOCUMENTS 3,691,343 A * 9/1972 Norman ..... 219/213
5,771,959 A * 6/1998 Westbrooks et al. ..... 165/11.1
6,336,304 B1 * 1/2002 Mimura et al. ..... 52/748.1
7,121,056 B2 * 10/2006 McKenna ..... 52/518
2004/0004066 A1 * 1/2004 Evans et al. ..... 219/213

* cited by examiner

*Primary Examiner* — Dana Ross
*Assistant Examiner* — Lindsey C Teaters
(74) *Attorney, Agent, or Firm* — Gerry A. Blodgett; David J. Blodgett; Blodgett & Blodgett, P.C .

(57) ABSTRACT

A roof de-icing system has a plurality of heating units connected in parallel to a common power source. The heating units can include one or more heating panels positioned along the lower edge of a roof, valley heating panels which extend along valleys of the roof, gutter heating panels which extend along the bottoms of gutters secured proximate a lower edge of the roof, and heating strips which extend along a roof below the drip line of a second higher roof. Each of the heating units has an indica to indicate a failure of that unit.

27 Claims, 10 Drawing Sheets

ROOF DE-ICING SYSTEM

INTRODUCTION

The present invention is directed to roof de-icing systems and, more particularly, to roof de-icing systems with a plurality of heating units connected in parallel.

BACKGROUND

The melting of ice and snow which accumulates on the roof of structures can create severe problems in cold weather. Heat from the structure partially melts the ice and snow, and the resulting water then runs down the roof. As this water encounters cold air at the lower edge, or eaves, of the roof, it freezes and forms an ice dam. The ice dam builds as this process repeats itself and eventually grows large enough to cause water to back up under the shingles on the roof and enter the structure. This is a common problem in cold climates and numerous solutions have been proposed.

One solution is to provide heating wires in a zig-zag pattern along the lower edge of the roof. These wires only partially melt the ice and snow on the roof, and additionally, may not be mounted to the roof in a secure manner, therefore, necessitating frequent replacement or repair.

Another solution commonly used is a metal roof slide comprising panels, typically formed of aluminum, mounted on top of the roof shingles along the lower edge of the roof. The roof slide is designed to facilitate the sliding of ice and snow off the roof.

A system of roof heater shingles is shown in U.S. Pat. No. 3,691,343 to Norman. In the Norman design a row of shingles are mounted along the lower edge of the roof and are connected in series to a power source. The shingles comprise a wire disposed along a back surface of a panel in a trapezoidal pattern. A valley section is also provided for melting ice and snow in the valley of the roof. A separate row of shingles is provided for each uninterrupted section of the roof, with the separate rows connected in parallel. An indicator is provided in the main power circuit of the system. The indicator light merely provides an indication of power to the entire system. If a shingle in the Norman design fails, there is no indication of that failure and that entire row of shingles ceases to operate, thereby allowing ice and snow to build up along that entire section of the roof.

It is an object of the present invention to provide an improved roof deicing system which reduces or wholly overcomes some or all of the aforesaid difficulties inherent in prior known devices. Particular objects and advantages of the invention will be apparent to those skilled in the art, that is, those who are knowledgeable and experienced in this field of technology, in view of the following disclosure of the invention and detailed description of certain preferred embodiments.

SUMMARY

The principles of the invention may be used to advantage to provide a plurality of heating units connected in parallel to a common power source. The heating units preferably include one or more heating panels, valley heating panels, gutter heating panels and heating strips.

In accordance with a first aspect a plurality of heating panels are mounted along the eaves of a roof, either over an existing finished roof or under new roofing construction, each of the heating panels being connected in parallel to a power source. A heating element is disposed within or along each of the heating panels. A plurality of indicators are operatively connected to the heating panels, each indicator indicating a failure of its corresponding panel. The parallel connection of each panel to the power source ensures that if any panel were to fail, the remaining panels would continue to operate. Correspondence of the individual indicators to the panels provides identification of the specific panel(s) which has failed, to facilitate repair or replacement of such failed panel(s).

The indicators are, in a preferred embodiment, lights which indicate a failure of the panel to which they are connected. When a single panel fails, the indicator light will let the user know which panel has failed and, correspondingly, allow that single panel to be replaced or repaired.

In accordance with another aspect, a valley heating panel is provided which is disposed along a valley of the roof and is connected in parallel with the plurality of heating elements. The valley heating panel preferably comprises a flexible member carrying a heating element and is typically covered with flashing. Preferably the valley heating panel also has a failure indicator operating in the same manner as the indicator of the heating panels described above.

In accordance with another aspect, a gutter heating panel is provided which is disposed along the interior bottom surface of a gutter. The gutter heating panel preferably comprises a flexible member carrying a heating element and has a failure indicator operating like the indicators discussed above.

In accordance with yet another aspect, a heating strip is provided which is disposed along a roof under the lower edge of a higher roof from which rain, melting ice, and snow drips. The heating strip preferably comprises a flexible member carrying a heating element and also has a failure indicator.

From the foregoing disclosure, it will be readily apparent to those skilled in the art, that is, those who are knowledgeable or experienced in this area of technology, that the present invention provides a significant technological advance. Preferred embodiments of the roof de-icing system of the present invention can provide a simple construction offering rugged and reliable operation with reduced manufacturing, maintenance, and repair costs over other known systems. Connecting multiple heating units in parallel and also providing individual indicators ensures that any failure of a heating element in an individual heating unit will only affect that heating unit, allowing the rest of the system to continue to operate, while notifying a user which unit has failed. These and additional features and advantages of the invention disclosed here will be further understood from the following detailed disclosure of certain preferred embodiments.

BRIEF DESCRIPTION OF THE DRAWINGS

Certain preferred embodiments are described in detail below with reference to the appended drawings wherein.

Figure 1:
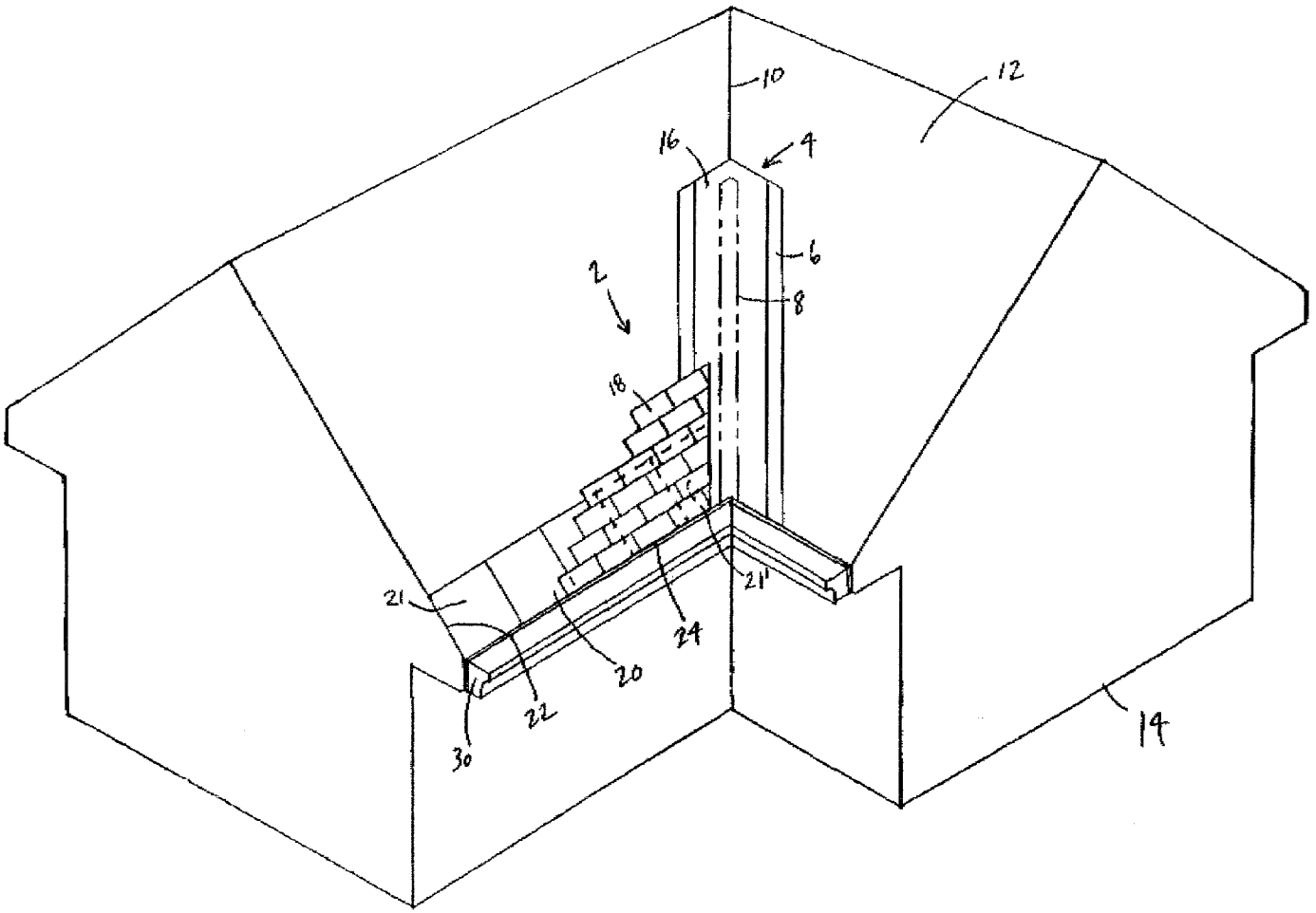
FIG. 1 is a schematic perspective view of a preferred embodiment of the roof de-icing system of the present invention, shown partially assembled in new construction.

The figures referred to above are not drawn necessarily to scale and should be understood to present a simplified representation of the invention, illustrative of the basic principles involved. Some features of the roof de-icing system depicted in the drawings have been enlarged or distorted relative to others to facilitate explanation and understanding. The same reference numbers are used in the drawings for similar or identical components and features shown in various alternative embodiments. Roof de-icing systems as disclosed above, will have configurations and components determined, in part, by the intended application and use environment.

DETAILED DESCRIPTION OF CERTAIN PREFERRED EMBODIMENTS

Unless otherwise stated, or otherwise clear from the context below, directional references used here are based on the orientation of components and assemblies shown in the appended drawings. These directional references assume a structure, such as a house supporting a roof on an upper surface thereof. The roof may be flat but is typically pitched with the uppermost point of the roof being considered the upper edge and the opposed edge where water will drip off the roof being considered the lower edge. Horizontally refers to a lateral direction, e.g. along the lower edge of the roof, substantially parallel to the surface, such as the ground, upon which the structure sits.

A roof de-icing system may include, in certain preferred embodiments, a plurality of heating units connected in parallel to a common power source. The heating units can include one or more heating panels, valley heating panels, gutter heating panels and heating strips, each of which is discussed in further detail below.

Figure 3:
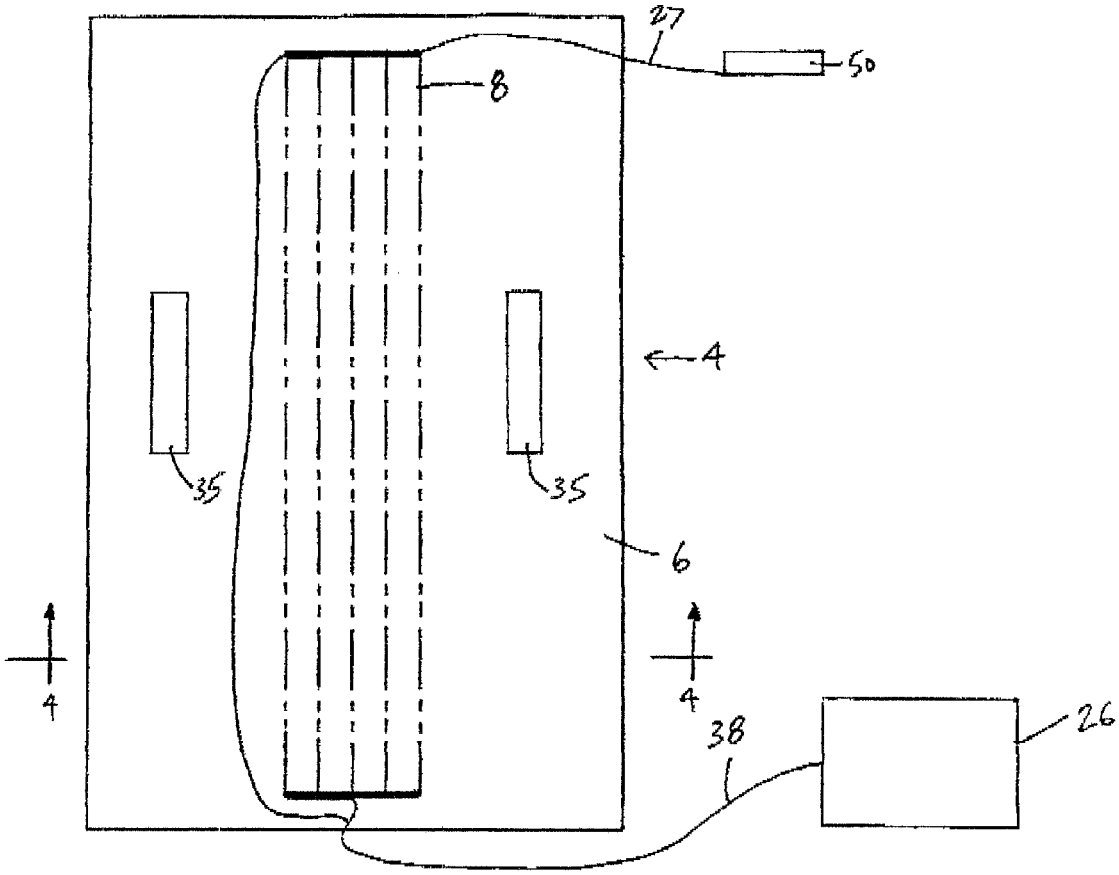
FIG. 3 is a schematic plan view of a preferred embodiment of a valley heating panel of FIG. 1 prior to installation.

A first preferred embodiment of a roof de-icing system, generally designated by reference numeral 2, is shown in FIG. 1. Valley heating panel 4, comprising a flexible member 6 carrying a heating element 8 (shown in broken lines), is attached to valley 10 of roof 12 of structure 14 (depicted here as new construction). Valley heating panel 4 is shown in FIG. 3 and discussed in detail below. It is to be appreciated that valley heating panel 4 may extend along the entire surface of valley 10, or as depicted here, may extend only along a portion of the valley. The length of valley heating panel 4 will depend on weather conditions, construction limitations, and other variables which will be obvious to those skilled in the art, that is, those with knowledge or experience in this particular field, given the benefit of this disclosure. Valley heating panel 4 can be attached to roof 12 in any known manner, such as by nailing, with care being taken to nail through flexible member 6 only in the areas outside of heating element 8 so as to maintain the integrity of the heating element 8. Flashing 16 is secured to roof 12 over valley heating panel 4 in a manner similar to flexible member 6, again taking care to avoid nailing through heating element 8. Flashing 16 is, for example, a thin sheet of aluminum which can be nailed along valley 10 providing protection from the elements for valley heating panel 4 and roof 12.

Multiple heating panels 20 extend from a side edge 22 of roof 12 horizontally along and proximate lower edge 24 to a point where they partially overlap flashing 16 but preferably do not overlap heating element 8. Further description of heating panels 20 follows below with reference to FIGS. 2 and 2A. Where a section of roof 12 has no valley, it is to be appreciated that multiple heating panels 20 will extend along lower edge 24 from one side edge of the roof to the other. Heating panels 20 are secured to roof 12 preferably with roofing nails (not shown) or other appropriate securing means known by those skilled in the art.

In a preferred embodiment, end panels 21 are provided. End panels 21 are installed as the first and or last panel in a row of panels and abut a side edge 22 of roof 12 or a change in roof structure such as valley 10. End panels 21 carry no heating element (described below in reference to FIG. 2) so that they can be cut to length when installed without concern for compromising the circuitry of the roof de-icing system.

In a preferred embodiment, one end panel 21', which abuts an adjoining heating panel 20 on one side and ends proximate valley 10 on its other side, has one of its sides, specifically the side proximate the valley, formed on an angle parallel to the angle formed by the valley and lower edge 24. End panel 21' typically is sized so that it only overlaps a portion of flashing 16 and does not overlap the area of valley heating panel 4 containing heating element 8.

It is to be appreciated that for each section of a roof, that is, for any continuous section of roof uninterrupted by a valley, dormer, or other change in the roof structure, there can be a series of heating panels extending along the roof and abutting one another. This provides flexibility in design of the heating system, and easier replacement and/or repair of individual heating panels.

Roofing shingles 18 are then secured to roof 12 in typical fashion over heating panels 20. Shingles 18 preferably extend horizontally along roof 12 to a point where they only partially overlap flashing 16, so that shingles 18 are not nailed into heating element 8, which is typically hidden from view when the flashing is installed.

In a preferred embodiment, gutter heating panels 28 (seen in FIG. 5 and discussed in detail below) are positioned within gutters 30, which are secured to structure 14 just below lower edge 24 of roof 12.

Figure 2:
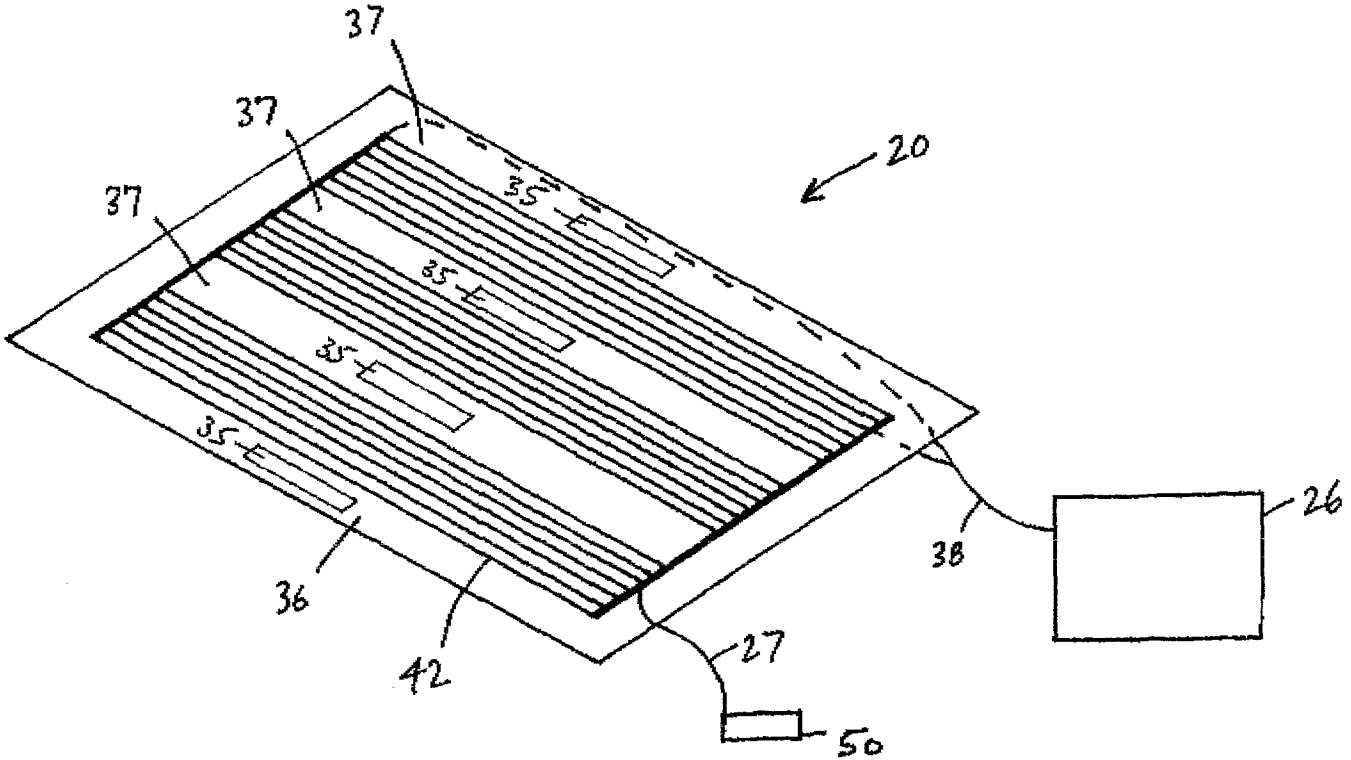
FIG. 2 is a schematic perspective view of a preferred embodiment of a heating panel of FIG. 1.

A preferred embodiment of heating panel 20 used in new construction is shown in greater detail in FIG. 2. Heating panel 20 is comprised of flexible member 36. Flexible member 36 is typically a substantially planar member formed of rubber or other suitable material, carrying heating element 42. The term "carries", as used here, includes a construction where a heating element is disposed within or, as shown, along a surface of a member such as flexible member 36. Heating element 42 is typically a resistive element such as wire or cable, which is connected via power cable 38 to power source 26 and provides heat when energized. Power source 26 is typically located remote from heating panel 20 and may be a low voltage power source to provide additional safety for individuals who may come in contact with the system.

Each heating panel 20 is preferably connected to power source 26 in parallel connection with the other heating panels and heating units. Connecting these elements in parallel ensures that if any particular heating unit were to fail, the other heating units would continue to operate. This is especially advantageous in the harsh conditions of northern climates where ice dams can cause severe damage to a structure. With the advantage of the combination of the parallel connections and the indicators, when any particular heating unit fails, the occupant of the building or other system operator is made aware of that particular failure by its corresponding indicator. Advantageously, however, the rest of the system continues to operate. The system operator thus has the opportunity to repair or replace only the specific failed heating unit, while being assured that until such replacement or repair is made the rest of the de-icing system continues to operate.

Nailing strip areas 37 are regions along flexible member 36 through which heating elements 42 do not extend. This allows for shingles 18 to be placed on heating panels 20 and nailed through the heating panels to roof 12 without compromising the heating panels. The dimensions and number of nailing strip areas 37 are will vary to accommodate the size of shingles 18 that will be nailed through heating panel 20. Heating panel 20 may be appropriately marked with marking 35 to indicate to an installer that nails are not to be driven through heating panel 20 in any areas other than nailing strip areas 37. Marking 35 may be a label carrying written instructions to nail only in the appropriate areas, such as "Nail Only in This Area", color coding, or any other suitable means which would provide a caution against nailing through an area of heating panel 20 which carries a heating element 42.

Indicator 50 is operatively connected to heating element 42 via power cable 27 to indicate a failure of that particular heating panel 20. Indicator 50 is typically a light which is illuminated when roof de-icing system 2 is operational and heating panel 20 is functioning properly, but is not illuminated when roof de-icing system 2 is operational and heating panel 20 is not functioning properly. Alternatively, in another embodiment the indicator 50 could be illuminated only when there is a failure of that particular heating panel 20. It is to be appreciated that the indicator 50 can be secured to or located remotely from the heating panels 20. The indicator 50 may be located, for example in the soffit of the structure below the eaves, or near a remotely mounted switch for operating the de-icing system, or in any other convenient location. In any case, the indicator 50 provides a method to determine which particular heating panels 20 are operational and/or non-operational. This is highly advantageous since the particular non-working panel can quickly and easily be located and thereafter replaced or repaired.

The dimensions of each heating panel 20 may vary and will be determined based on various factors including the size of the roof and the materials from which the panels are manufactured. Such dimensions will become readily apparent to those skilled in the art given the benefit of this disclosure. Multiple heating panels of a convenient size provide flexibility in installation and easy replacement or repair upon failure.

Figure 2A:
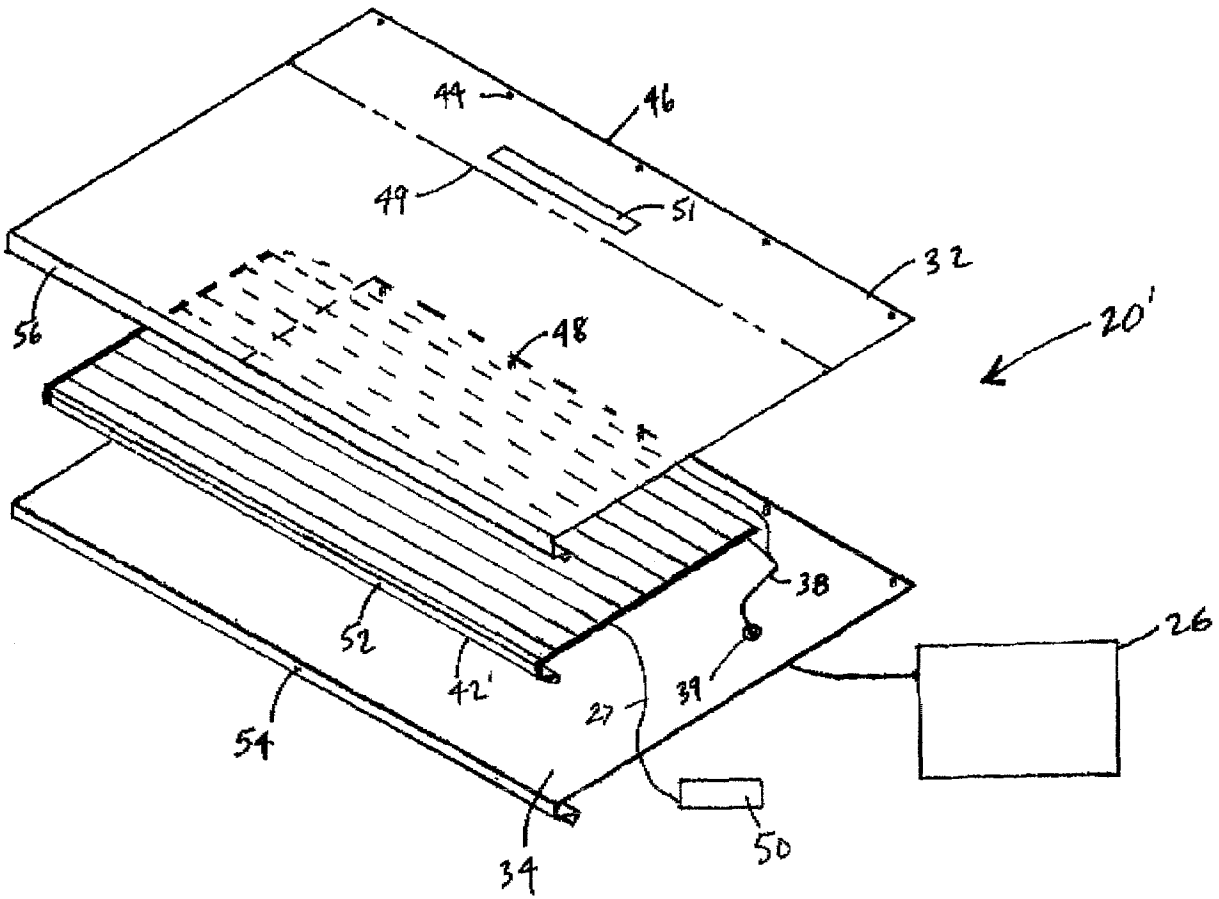
FIG. 2A is a schematic perspective exploded view of another preferred embodiment of a heating panel of the present invention.

A preferred embodiment of a heating panel used on both new construction and existing finished roofs is shown in exploded form in FIG. 2A. Heating panel 20' comprises upper panel 32, lower panel 34, and heating element 42', disposed between the upper and lower panels. When assembled, heating panel 20' forms a single integrated unit for installation and removal. Upper and lower panels 32, 34 are typically formed of aluminum, plastic, or other suitable materials which will become readily apparent to those skilled in the art given the benefit of this disclosure. Heating element 42' is electrically connected by power cable 38 to power source 26. In this embodiment power cable 38 is fed through aperture 39 in lower panel 34 and from there through an aperture (not shown) in roof 12 where it is subsequently routed to the power source 26. In another preferred embodiment the power cable 38 may be located proximate lower edge 52 of heating element 42' and from there routed into or below the eaves of roof 12 whereby access to power cable 38 may be had from below the roof 12. Other methods of routing power cable 38 to an appropriate power source 26 will become readily apparent to those skilled in the art given the benefit of this disclosure.

In another embodiment, flexible member 36 may be used in place of heating element 42' and placed in like manner between upper and lower panels 32, 34.

Upper panel 32 has a series of pre-drilled holes 44 proximate its upper edge 46 to receive nails (not shown) which are used to secure heating panel 20' to the roof 12. Holes 48 are similarly provided in lower panel 34 and are aligned with holes 44 when heating panel 20' is assembled or manufactured. A marking is provided on the surface of upper panel 32 which indicates the area below which nails should not be driven through heating panel 20'. The marking may be provided by etching 49, which is typically a line etched into the surface of upper panel 32. The marking may also be provided by a label 51 which typically contains a warning phrase such as "Do Not Nail Below This Line" printed on its surface.

Lower edge 54 of upper panel 32 is bent downwardly, inwardly, and then outwardly to form a Z shape which matches the shape of a typical drip edge installed along lower edge 24 of roof 12. Lower edge 52 of heating element 42' and lower edge 56 of upper panel 32 are similarly formed such that they matingly engage one another when heating panel 20' is assembled or manufactured. Heating element 42' extends between upper panel 32 and lower panel 34 from their lower edges 56, 54, respectively, toward but not overlapping nail holes 44, 48 to ensure that nails are not driven through heating element 42'. Indicator 50 is operably connected via power cable 27 to heating element 42' to indicate a failure of heating panel 20'. It is to be appreciated that, as described above in reference to FIG. 2, indicator 50 may be secured to or located remotely from heating panel 20'.

When installed, heating panel 20' is fastened in place with nails or other suitable fastening means. In new construction, roofing shingles are then installed in typical fashion such that they overlap only a portion of upper edge 46 to facilitate the runoff of water, ice, and snow. When heating panel 20' is installed over existing shingles, upper edge 46 is partially tucked under the lower edge of an appropriate row of existing shingles to maintain the overlapping manner in which roofing is installed to facilitate the runoff of water, snow and ice.

In a preferred embodiment, heating panels 20' are colored to match the color of the roofing shingles, or in any other desired color. The coloring of heating panel 20' may be done by painting the panels, forming them from pre-colored material, or by any other suitable means which will become readily apparent to those skilled in the art given the benefit of this disclosure. Heating panels 20' may also be created from clear material, which would typically be used on existing roofs. Such clear heating panels 20' would allow the existing roofing shingles to show through, eliminating any concern over matching colors or creating desirable color schemes.

In another embodiment heating panel 20' is formed of a single panel rather than an upper and lower panel along with a heating element 42'. Such a panel would typically be formed by injection molding, casting, or other suitable manufacturing methods which would provide for heating element 42' to be embedded within or disposed along a surface of an appropriate material such as plastic, rubber, or metal such as aluminum.

It is to be appreciated that other constructions of heating units such as heating panels which will provide the required function of supplying heat to a roof in order to melt ice and snow will become apparent to those skilled in the art, given the benefit of this disclosure.

A preferred embodiment of valley heating panel 4 is shown in FIG. 3. Valley heating panel 4 comprises flexible member 6 formed of rubber, or any other suitable material, which will allow the valley heating panel 4 to lay flush with the surface of the roof 12 when it is laid in valley 10. Valley heating panel 4 carries heating element 8. The term "carries", as used here, includes a construction where heating element 8 is disposed within (see FIG. 4) or along a surface of flexible member 6. Heating element 8 is typically a resistive element such as a wire, electrically connected via a power cable 38 to a power source 26, typically located remotely from the roof. Valley heating panel 4 is, in preferred embodiments, connected to power source 26 in parallel connection with other heating units such as heating panels 20. It will be readily apparent to those skilled in the art how to appropriately route power cable 28 from heating element 8 to power source 26 through structure 14 given the benefit of this disclosure. Indicator 50 is operably connected to heating element 8 via power cable 27 to indicate a failure of that particular valley heating panel 4. Valley heating panel 4 may be appropriately marked with marking 35 to indicate to an installer the areas of valley heating panel 4 through which nails can be driven. Marking 35 may be a label carrying written instructions to nail only in the appropriate areas, such as "Nail Only in This Area", color coding, or any other suitable means which would provide a caution against nailing through an area of valley heating panel 4 which carries a heating element 8.

Figure 4:
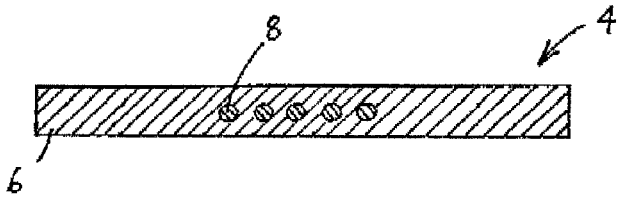
FIG. 4 is a schematic section view taken along line 4-4 of FIG. 3.

A preferred embodiment of valley heating panel 4 is shown in FIG. 4 where heating element 8 is shown embedded within flexible member 6. As noted above, in another preferred embodiment heating element 8 may be disposed along a surface of flexible member 6. The flexible member 6 would typically be installed with a longitudinal bend, so as to have a V shaped cross section, rather than the flat cross section shown in FIG. 4 for an uninstalled panel.

It is to be appreciated that heating panel 20, as described above in reference to FIG. 2 may also have a construction similar to that shown in FIG. 4. That is, the heating element 42 of heating panel 20 may be embedded within flexible member 36 rather than disposed on its surface as shown in FIG. 2.

Figure 5:
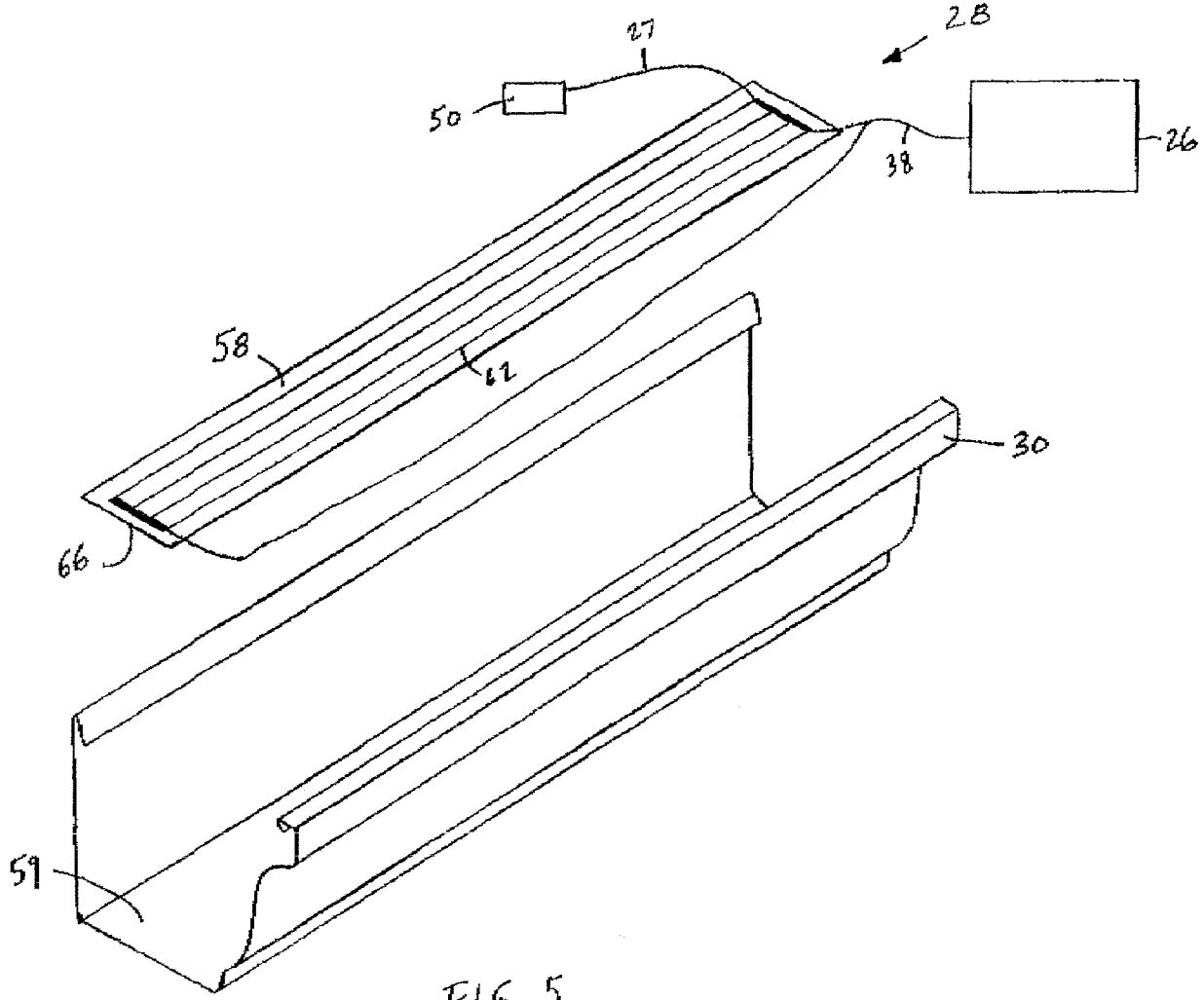
FIG. 5 is a schematic perspective exploded view of a preferred embodiment of a gutter heating panel of the present invention.

A preferred embodiment of gutter heating panel 28 is shown in FIG. 5. Gutter heating panel 28 is comprised of flexible member 58 disposed along the interior bottom surface 59 of gutter 30. Flexible member 58 is of a construction similar to that of flexible member 36 and valley heating panel 4 and is typically substantially planar, formed of rubber or other suitable material, having heating element 62 disposed along a surface thereof or embedded therein. Heating element 62 is typically a resistive element such as wire or cable and provides heat when energized. Heating element 62 is connected to power cable 38, which is in turn connected to power source 26, preferably in parallel connection with the other heating units such as heating panels 20 and valley heating panels 4. Indicator 50 is operably connected to heating element 62 via power cable 27 to indicate a failure of that particular gutter heating panel 28. Adhesive such as epoxy can be applied to the back surface 66 of flexible member 58 to secure flexible member 58 to the bottom surface 59 of gutter 30. In another preferred embodiment, no such adhesive is applied such that gutter heating panel 28 can be easily removed and re-installed in gutter 30.

Figure 6:
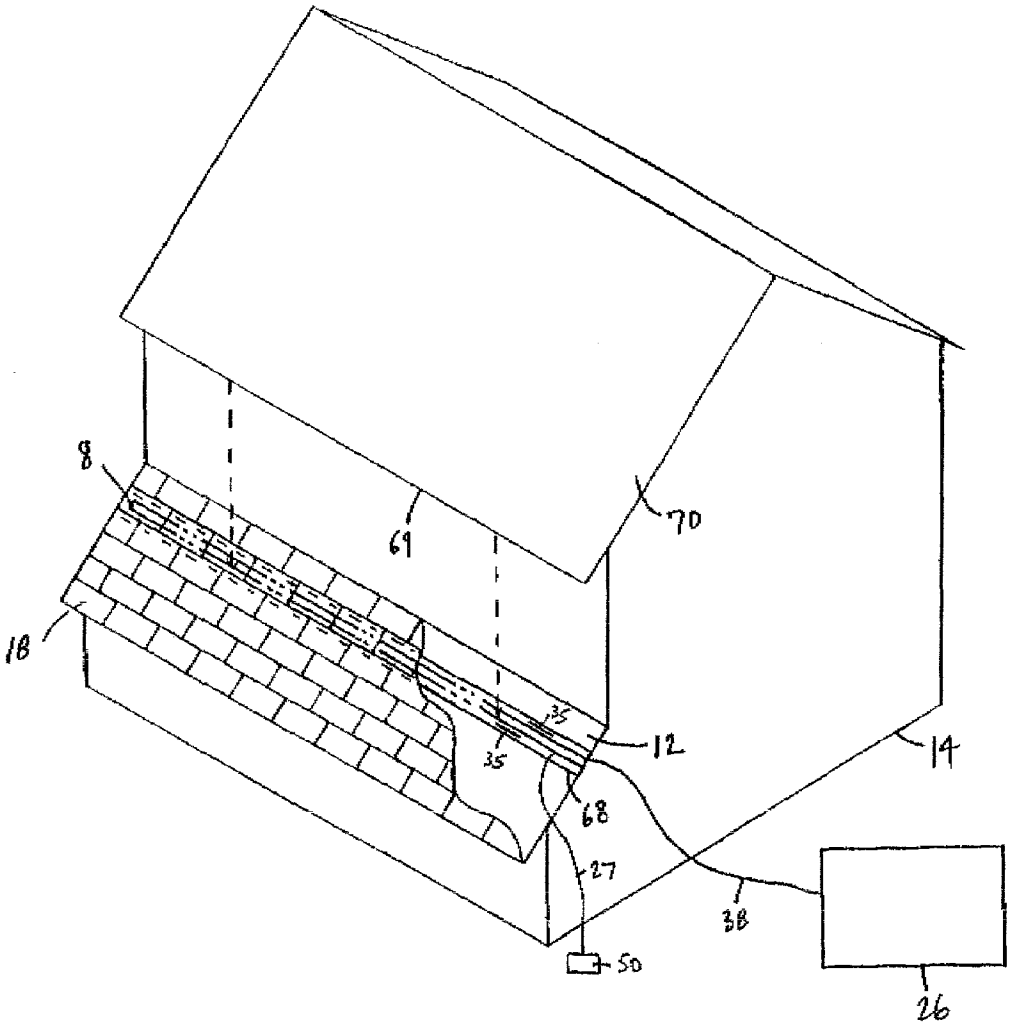
FIG. 6 is a schematic perspective view of a preferred embodiment of a heating strip of the present invention.

Another preferred embodiment is shown in FIG. 6. Heating strip 68 is attached to roof 12, where roof 12 is positioned beneath the lower edge 69 of a higher roof 70 such that melting ice and snow (shown with dashed arrows) dripping off higher roof 70 strikes roof 12 along the path of heating strip 68. It is to be appreciated that lower edge 69 of higher roof 70 may be the lower edge of an entire roof as shown here, or may be the lower edge of a dormer or other partial roof section. The term "heating strip", as used here, refers to a heating unit which is a member extending along a section of roof which carries a resistive element in order to provide a heat source along a roof. In one preferred embodiment, heating strip 68 is of similar construction to valley heating panel 4 (see FIGS. 1, 3, and 4) and is a substantially planar member with a heating element 8 disposed on a surface of the substantially planar member or embedded therein. Heating strip 68 is likewise connected via power cable 38 to power source 26, preferably in parallel connection with other heating units such as heating panels 20, valley heating panels 4, and gutter heating panels 28. Indicator 50 is operably connected to heating strip 68 via power cable 27 to indicate a failure of that particular heating strip. Heating strip 68 is fastened to roof 12 with nails or other known fastening means, and roofing shingles 18 are thereafter applied over heating strip 68. Heating strip 68 may be appropriately marked with marking 35 to indicate to an installer the areas in which nails are to be driven through heating strip 68. It is to be appreciated that other constructions of heating strip 68 which will provide the required function of supplying heat to roof 12 in order to melt ice and snow will become apparent to those skilled in the art, given the benefit of this disclosure.

In a preferred embodiment, every heating unit, that is, each heating panel, valley heating panel, gutter heating panel, and heating strip, is connected to the power source in parallel connection with each of the other heating units, and has its own indicator light to indicate a failure of that particular heating unit.

Figure 7:
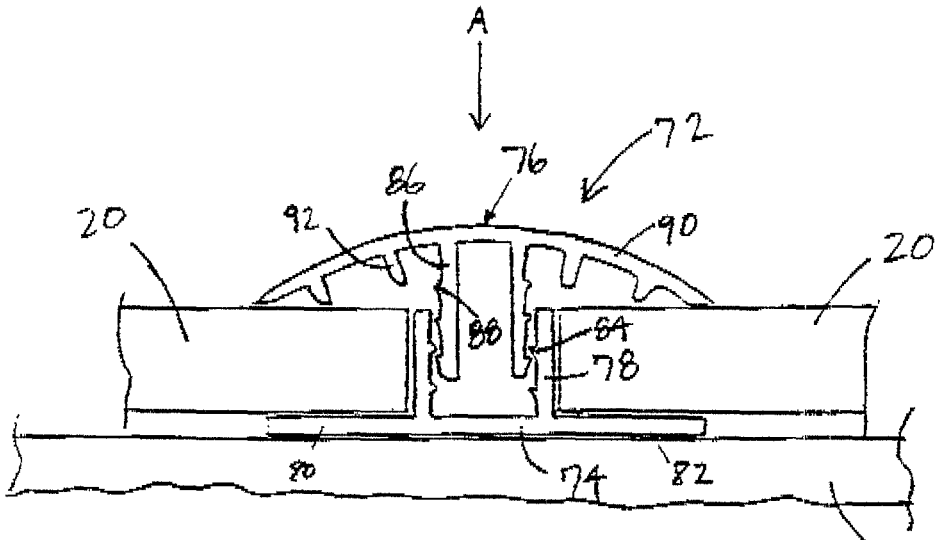
FIG. 7 is a schematic elevation view of a preferred embodiment of a clip interconnecting heating panels of the present invention.

A preferred embodiment of mounting adjoining heating panels 20 to an existing finished roof is shown in FIG. 7. Clip 72 is provided for attaching adjacent heating panels 20 to the roof 12. Clip 72 comprises female base 74 and male insert 76 and is shown partially installed. Base 74 comprises a U-shaped channel 78 and feet 80, 82 extending outwardly from the bottom of channel 78. The feet 80, 82 are secured to the roof 12 by known means such as nailing such that the open portion of channel 78 faces upwardly away from the roof 12. Channel 78 is serrated with engaging teeth 84 which project from the walls of and into the interior of channel 78. Insert 76 comprises a U-shaped mating channel 86 having meshing teeth 88 projecting from the exterior of the walls of channel 86. Channel 86 is slightly narrower than channel 78 such that the engaging teeth 84 and meshing teeth 88 engage one another when insert 76 is pressed onto base 74 in the direction of arrow A, thereby providing a sealing, yet releasable, engagement of the insert and base. It is to be appreciated that insert 76 can be removed by pulling insert 76 upwardly away from base 74 with a force that is sufficient to overcome the retaining force exhibited by engaging teeth 84 and meshing teeth 88. Cap 90 of insert 76 is an arcuate member extending outwardly from both sides of the base of channel 86 and curving from the base toward the open end of the channel. Cap 90 is formed of a flexible material such as plastic or other suitable material which will allow insert 76 to partially flex as it is inserted into base 74 yet provide sufficient strength to keep clip 72 in its assembled condition. Tabs 92 project from cap 90 and engage the top surfaces of heating panels 20, partially compressing the heating panels when insert 76 is fully engaged with base 74, thereby providing a weather tight seal.

Figure 8:
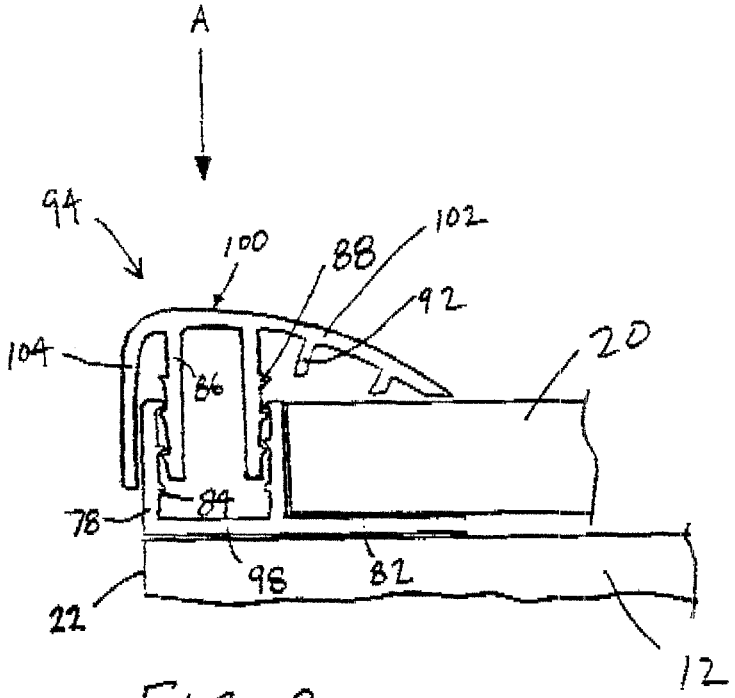
FIG. 8 is a schematic elevation view of a preferred embodiment of an end clip interconnecting heating panels of the present invention.

Another preferred embodiment showing a heating panel 20 attached proximate side edge 22 of roof 12 is shown in FIG. 8. End clip 94 is provided for attaching heating panel 20 along side edge 22 of roof 12. End clip 94 comprises female base 98 and male insert 100 and is shown partially installed. Base 98 comprises a U-shaped channel 78 and one foot 82 extending outwardly to one side of and from the bottom of channel 78, with foot 82 extending away from side edge 22 of roof 12 when end clip 94 is installed. Foot 82 is secured to the roof 12 by known means, such as nailing, such that the open portion of channel 78 faces upwardly away from the roof 12. Channel 78 is serrated with engaging teeth 84 which project into the interior of channel 78 along its walls. Insert 100 comprises a U-shaped mating channel 86 having meshing teeth 88 projecting from the exterior of the walls of channel 86. Channel 86 is slightly narrower than channel 78 such that the engaging teeth 84 and meshing teeth 88 engage one another when insert 100 is pressed onto base 98 in the direction of arrow A, thereby providing a sealing, yet releasable, engagement of the insert and base. It is to be appreciated that insert 100 can be removed by pulling insert 100 upwardly away from base 98 with a force that is sufficient to overcome the retaining force exhibited by engaging teeth 84 and meshing teeth 88. Cap 102 of insert 100 is an arcuate member extending outwardly from one side of the base of channel 86 and curving toward the open end of the channel. Cap 102 is formed of a flexible material such as plastic or other suitable material which will allow insert 100 to partially flex as it is inserted into base 98 yet provide sufficient strength to keep end clip 94 in its assembled condition. End wall 104 extends from the base of channel 86 on the side opposed to cap 102 toward the open end of channel 86, parallel to and slightly spaced from the exterior of channel 86. End wall 104 extends along the exterior of channel 78 when end clip 94 is assembled, providing an overlapping weather tight seal between end wall 104 and channel 78. Tabs 92 project from cap 102 and engage the top surface of heating panel 20 when end cap 94 is assembled, partially compressing the heating panel and thereby providing a weather tight seal.

Figure 9:
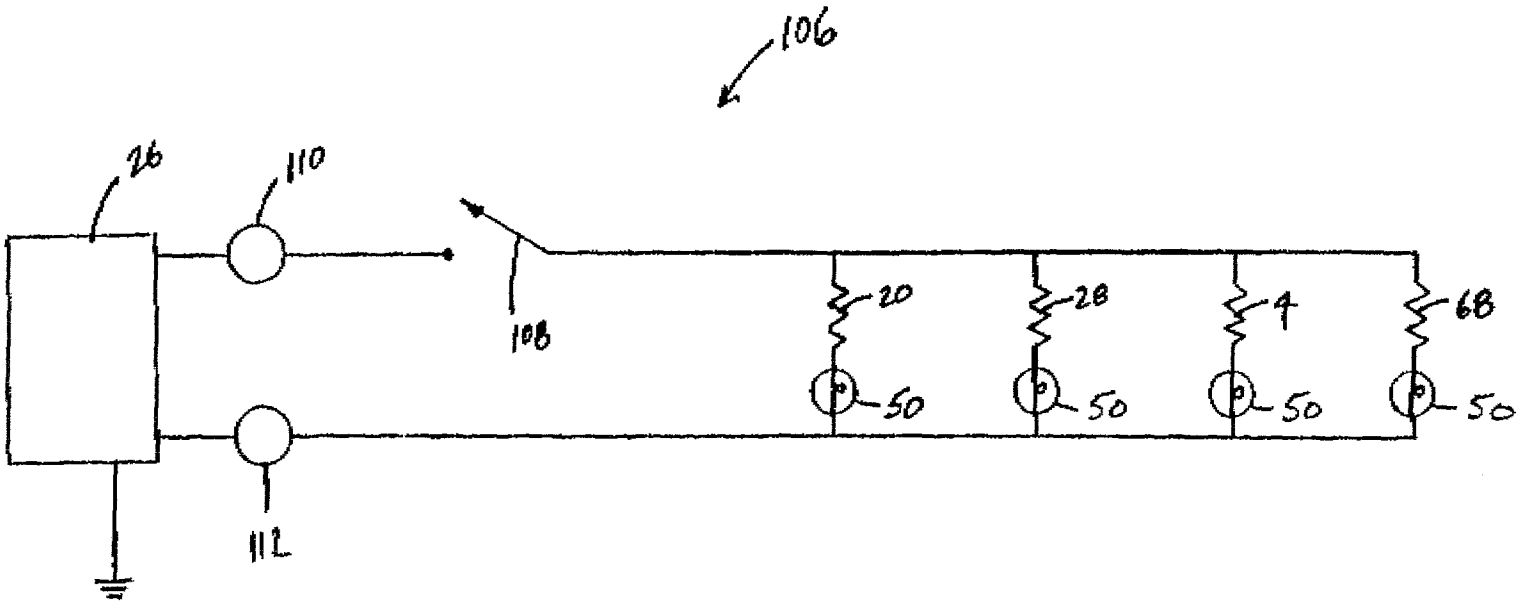
FIG. 9 is a schematic circuit diagram of a preferred embodiment of the power supply circuit of the present invention.

In a preferred embodiment, as seen in FIG. 9, each heating panel 20, gutter heating panel 28, valley heating panel 4, and heating strip 68 (each depicted here as a resistive element) are connected to power source 26 in parallel within electrical power system 106. Power source 26 is typically an AC circuit, but may be any other suitable power source such as a low voltage system which would provide added safety. Switch 108 is provided in-line with power source 26, and may be located inside or outside the structure 14. In a preferred embodiment thermostat or thermal switch 110 is provided, typically located outside structure 14, which allows the roof de-icing system to be controlled by the outside temperature. This would allow an individual, for example, to operate the system whenever the outside temperature reached or went below a desired temperature such as 35° F.

In another preferred embodiment, timer 112 is provided in-line with the power source 26 to allow an individual to control when the de-icing system operates. The individual could, for example, choose to operate the system only during night time hours when the outside temperature and electric rates are typically lower.

Figure 10:
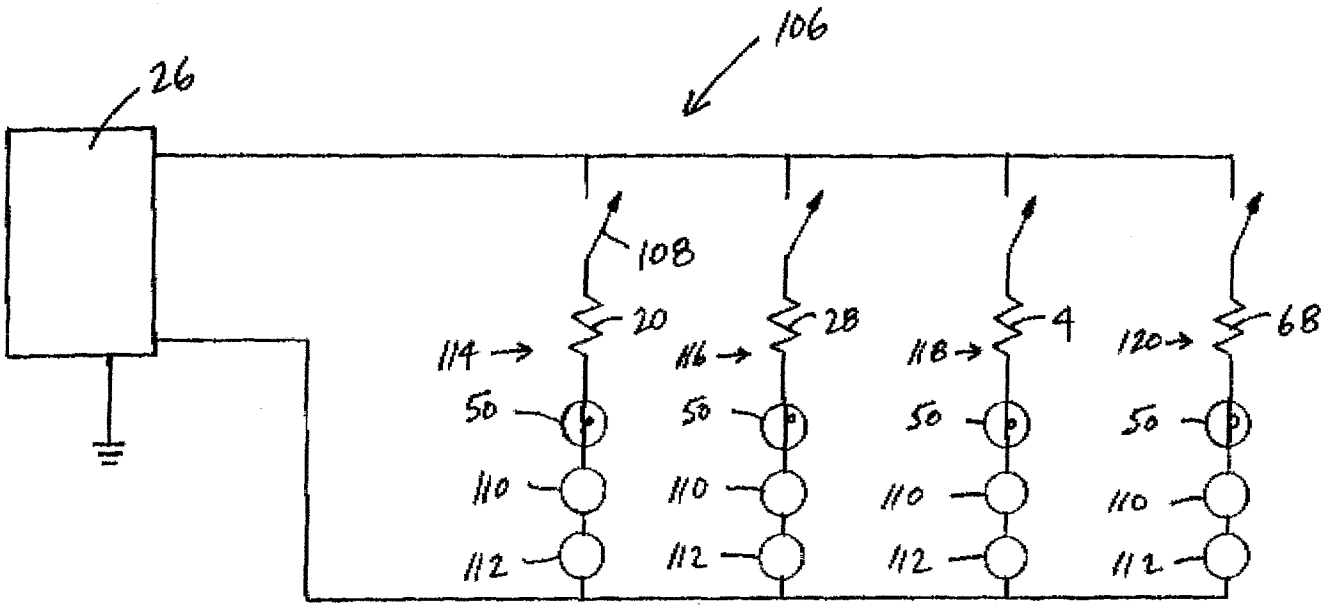
FIG. 10 is a schematic circuit diagram of an alternative embodiment of the power supply circuit showing multiple zones.

Another preferred embodiment of the electrical power system is shown in FIG. 10. The roof de-icing system can preferably be operated in distinct zones. Heating zones 114, 116, 118, 120 are each operated by a switch 108 which allows that respective zone to be individually controlled. Zone 114, for example could consist of a single heating panel 20, as shown here, multiple heating panels 20, or a combination of different elements, such as a number of heating panels along with a gutter heating panel and a valley heating panel. In another preferred embodiment different combinations of devices could be could be grouped for functional reasons. For example, combining the elements that are on the north side of the structure to operate as one zone while the elements on the east, south, and west sides of the structure would be operated as separate zones. In a preferred embodiment, each zone would have its own indicator 50 and be connected in parallel with each of the other zones. In another preferred embodiment each element such as a heating panel 20, valley heating panel 4, gutter heating panel 28, or heating strip 68 would have its own indicator 50. In a preferred embodiment, each zone 114, 116, 118, 120 would have a corresponding thermal switch 110 and/or timer 112 to control the operation of that particular zone.

Figure 11:
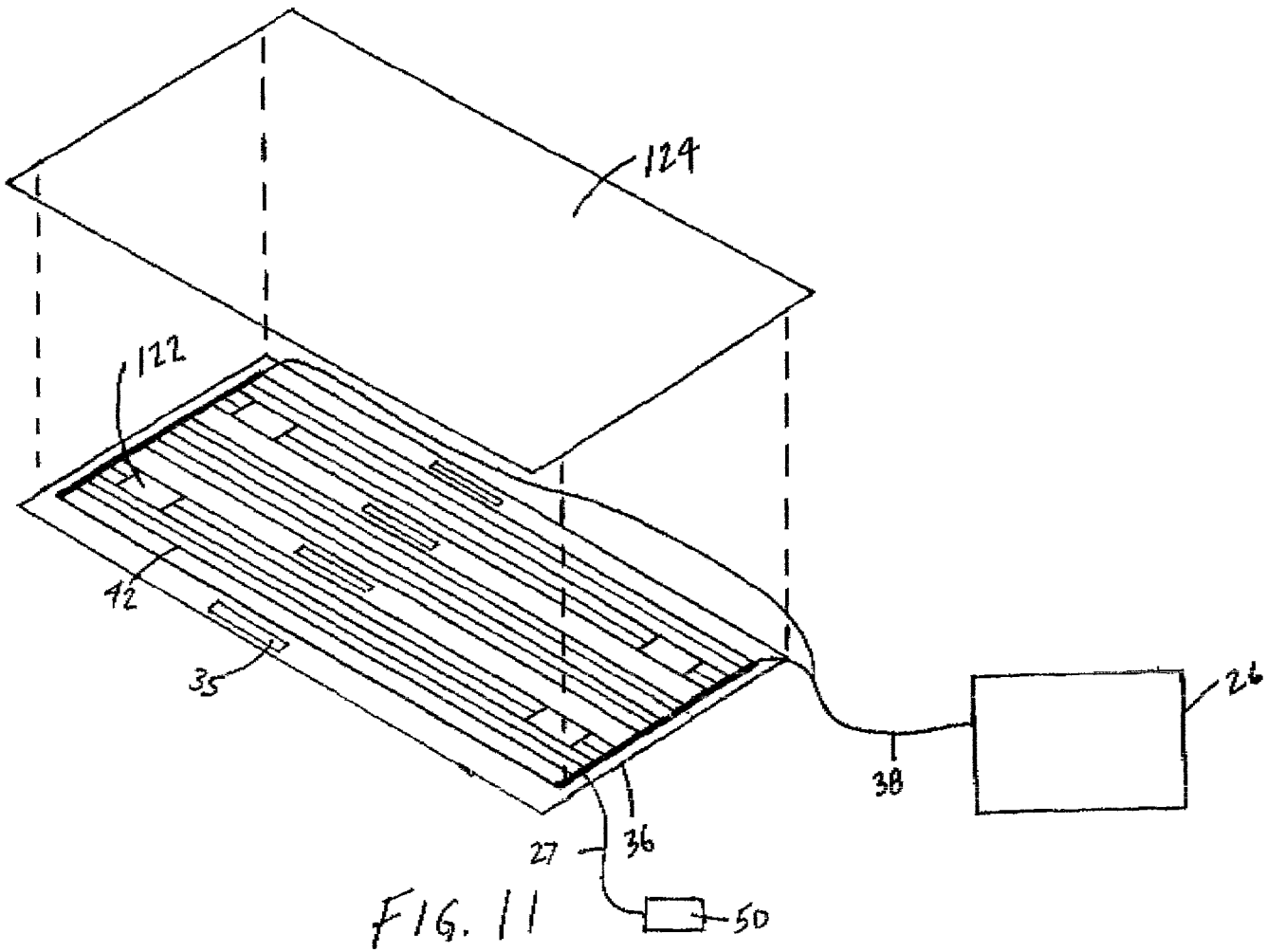
FIG. 11 is a schematic perspective exploded view of a preferred embodiment of a heating panel of the present invention secured to a roof slide.

Another preferred embodiment of mounting the flexible member 36 is shown in FIG. 11. Adhesive members 122 are secured to a top surface of flexible member 36, and flexible member 36 is subsequently secured to an under surface of roof slide 124 via adhesive strips 122. A roof slide, when used here, refers to a panel which is secured to a lower portion of a roof in order to facilitate ice and snow sliding off the roof. The roof slide is typically formed of aluminum but may be formed of any suitable material which facilitates such sliding of ice and snow, and is fastened to the roof in a known manner such as by nailing. Adhesive members 122 ensure that flexible member 36 is securely attached to an under surface of roof slide 124. Adhesive members 122 may be dual sided adhesive tape, roofing cement, spray adhesive, or other suitable adhesive material which will become readily apparent to those skilled in the art given the benefit of this disclosure. In another preferred embodiment adhesive members 122 may be an adhesive, epoxy, or other suitable material directly applied to the entire surface of flexible member 36 or the underside of roof slide 124.

In light of the foregoing disclosure of the invention and description of certain preferred embodiments, those who are skilled in this area of technology will readily understand that various modifications and adaptations can be made without departing from the true scope and spirit of the invention. All such modifications and adaptations are intended to be covered by the following claims.

I claim:

1. A roof de-icing system comprising, in combination:

a plurality of heating units attachable to a roof, each of the heating units being connected in parallel to a power source; and a plurality of indicators, each being operatively connectable to a corresponding one of the plurality of heating units to indicate a failure of that respective unit with each indicator located on the roof soffit, separate from, but in close proximity to the corresponding heating unit and visible from the ground.

2. A roof de-icing system in accordance with claim 1 wherein the heating units comprise heating panels comprising an upper panel, a lower panel, and a heating element disposed between the upper and lower panels.

3. A roof de-icing system in accordance with claim 2 wherein the heating element comprises a substantially planar member carrying an electrically resistive element.

4. A roof de-icing system in accordance with claim 3 wherein the resistive element comprises a wire.

5. A roof de-icing system in accordance with claim 1 wherein the indicators comprise lights.

6. A roof de-icing system in accordance with claim 1 further comprising a clip which is fastened to the roof and attached to the heating panels for attaching the plurality of heating panels to the roof.

7. A roof de-icing system in accordance with claim 6 wherein the clip comprises:

a base fastened to the roof having a U shaped channel, the channel having a plurality of teeth projecting from an interior of the channel;

at least one foot extending from a base of the channel, an insert having a U shaped mating channel;

a plurality of teeth projecting from an exterior of the mating channel;

a cap extending outwardly from the base of the mating channel; and a plurality of tabs projecting from a surface of the cap facing the channel to at least partially compress a surface of the heating panel, wherein the insert meshes with the base such that the teeth of the channel and the teeth of the mating channel releasably engage one another.

8. A roof de-icing system in accordance with claim 7 including fasteners that fasten the clip to the roof.

9. A roof de-icing system in accordance with claim 1 further comprising a thermal switch operatively connected to the power source to activate the heating units under desired temperature conditions.

10. A roof de-icing system in accordance with claim 1 further comprising a timer operatively connected to the power source to activate the heating units at desired time intervals.

11. A roof de-icing system in accordance with claim 1 wherein the heating units have markings to indicate an area in which the heating units are to be free of nails.

12. A roof de-icing system in accordance with claim 1 wherein each of the heating units comprises a heating panel comprising a substantially planar member carrying an electrically resistive element.

13. A roof de-icing system comprising, in combination:

a plurality of heating panels attachable to a roof, each of the heating panels being connected in parallel to a power source;

a plurality of indicators, each being operatively connected with a corresponding one of the plurality of heating panels to indicate a failure of that respective panel unit with each indicator located on the roof soffit, separate from, but in close proximity to the corresponding heating unit and visible from the ground; and a valley heating panel attachable to a valley of the roof and connected to the power source in parallel with the plurality of heating panels.

14. A roof de-icing system in accordance with claim 13 wherein the valley heating panel comprises a flexible member carrying a heating element.

15. A roof de-icing system in accordance with claim 13 further comprising a valley heating panel indicator to indicate a failure of the valley heating panel.

16. A roof de-icing system in accordance with claim 13 further comprising a gutter heating panel, the gutter heating panel being connected to the power source in parallel with the plurality of heating panels.

17. A roof de-icing system in accordance with claim 16 wherein the gutter heating panel comprises a substantially planar member carrying a heating element.

18. A roof de-icing system in accordance with claim 16 further comprising a gutter heating panel indicator to indicate a failure of the gutter heating panel.

19. A roof de-icing system in accordance with claim 16 further comprising a heating strip for attachment to a roof, the heating strip mounted to the roof along a drip line of runoff from a higher roof.

20. A roof de-icing system in accordance with claim 19 wherein the heating strip comprises a substantially planar member carrying a heating element.

21. A roof de-icing system in accordance with claim 19 further comprising a heating strip indicator to indicate a failure of the heating strip.

22. A roof de-icing system in accordance with claim 19 further comprising a plurality of switches operably connected to the power source, each switch controlling a heating zone comprised of at least one of a heating panel, a valley heating panel, a gutter heating panel, and a heating strip.

23. A roof de-icing system in accordance with claim 13 wherein the heating panels are adhesively secured to an underside of a roof slide, the roof slide being attachable to the roof with the heating panels disposed between the roof and the roof slide.

24. A roof de-icing system in accordance with claim 13 further comprising a switch to operate the power source.

25. A roof de-icing system in accordance with claim 13 further comprising at least one end panel formed free of heating elements to be custom cut to match the dimensions of the roof upon which it is installed.

26. A roof de-icing system comprising, in combination:

a plurality of heating units, the heating units comprising any number of heating panels, valley heating panels, gutter heating panels, and heating strips;

a power source, each heating unit being connected in parallel to the power source;

and a plurality of indicators, each indicator operatively connected to one of the plurality of heating units to indicate a failure of that respective heating unit unit with each indicator located on the roof soffit, separate from, but in close proximity to the corresponding heating unit and visible from the ground.

27. A roof de-icing system in accordance with claim 26 wherein each heating unit is operatively connected to a separate corresponding indicator.

* * * * *